United States Patent [19]

Kimura

[11] Patent Number: 4,669,124

[45] Date of Patent: May 26, 1987

[54] BEVERAGE CONTAINER WITH TAMPERPROOF SCREWTHREAD CAP

[75] Inventor: Kinichi Kimura, Tokyo, Japan

[73] Assignees: Yoken Co., Ltd.; Hosokawa Yoko Co., Ltd., both of Tokyo, Japan

[21] Appl. No.: 907,174

[22] Filed: Sep. 15, 1986

Related U.S. Application Data

[63] Continuation of Ser. No. 613,251, May 23, 1984, abandoned.

[51] Int. Cl.[4] ..... B65D 33/34

[52] U.S. Cl. ..... 383/80; 206/807; 215/218; 215/252; 222/153; 229/7 S; 383/5

[58] Field of Search ..... 229/7 S; 215/1 A, 216, 215/252, 253, 258, 220, 218, 330, 221, 250, 4, 5; 222/153; 206/216, 217, 807; 383/36, 116, 120, 904, 906, 80, 5; 220/288

[56] References Cited

U.S. PATENT DOCUMENTS

| | | | |
|---|---|---|---|
| 2,013,605 | 9/1935 | Greenison | 215/252 |
| 2,045,388 | 6/1936 | Guthrie | 215/252 |
| 2,423,582 | 7/1947 | Coleman | 215/330 X |
| 2,617,559 | 11/1952 | van der Spek | 215/1 A |
| 2,804,257 | 8/1957 | Hasler et al. | 383/36 |
| 3,342,326 | 9/1967 | Zackheim | 229/7 S |
| 3,407,976 | 10/1968 | Homma | 215/250 X |
| 3,730,336 | 5/1973 | Feldman | 229/7 S |
| 3,805,987 | 4/1974 | Horvath | 215/330 X |
| 4,261,478 | 4/1981 | Summers | 215/216 X |

FOREIGN PATENT DOCUMENTS

| | | | |
|---|---|---|---|
| 569025 | 7/1958 | Belgium | 229/7 S |
| 2904181 | 8/1980 | Fed. Rep. of Germany | 215/252 |
| 861079 | 2/1961 | United Kingdom | 229/7 S |
| 980859 | 1/1965 | United Kingdom | 229/7 S |

*Primary Examiner*—William Price
*Assistant Examiner*—Bryon Gehman
*Attorney, Agent, or Firm*—Parkhurst & Oliff

[57] ABSTRACT

A tamper-proof, bag-shaped container and straw is provided for drinking liquid contained therein. The container is formed by heat-sealing the edges of synthetic resin film sheets or paper sheets laminated with synthetic resin film. The container includes a straw heat-sealed between the sheets and in fixed contact therewith. The straw projects outwardly from the container at the upper end portion thereof and extends to the vicinity of the bottom of the container at the lower end thereof. A threaded cover is connected to a threaded upper end portion of the straw for screwing the cover on and off. The container includes a plurality of teeth, each having a guide side and a cut side. A frangible member is provided in the rotary path of the teeth and in the vicinity of the upper end portion of the straw. The frangible member is elastically deformed towards the guide side of the cover when screwing on the cover and is cut away upon contacting the cut side of the teeth when screwing off the cover.

4 Claims, 1 Drawing Figure

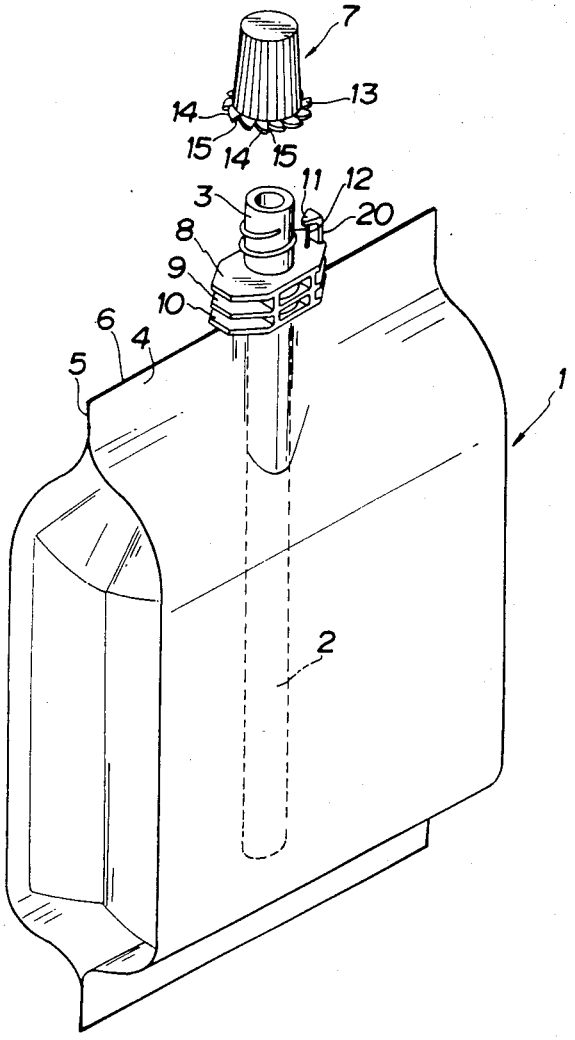
7
13
14
15
14
15
11
12
3
20
8
9
10
6
4
5
1
2

BEVERAGE CONTAINER WITH TAMPERPROOF SCREWTHREAD CAP

This is a continuation of application Ser. No. 613,251 filed May 23, 1984 now abandoned.

BACKGROUND OF THE INVENTION

The instant invention relates to a tamper-proof, bag-shaped container for drinking liquid in which the container is formed by heat-sealing the edges of synthetic resin film sheets or paper sheet laminated with synthetic resin film. More particularly, the instant invention relates to a tamper-proof, bag-shaped drinking container with a straw heat-sealed between two edges at one end thereof for sucking out a liquid contained within the container.

Bag-shaped containers formed by heat-sealing the edges of synthetic resin film sheets or by heat-sealing the edges of paper sheets laminated with synthetic resin film have been frequently used as drinking containers. It was necessary in such containers to first cut off a corner of the container to form an opening and then insert a straw for sucking out the liquid contained therein.

It is important with regard to public sanitation and safety for such containers to provide a means for indicating whether the original manufacturer's seal has previously been opened or tampered with.

Heretofore, there have been containers with a cap seal coated with plastic film to form an original manufacturer's seal. This type of cap seal has experienced problems since the use of plastic film to hermetically seal the cover to the container makes the cap hard to remove. Additionally, containers with a cap seal coated with plastic film require two steps to open the container's first, the plastic film must be removed and second, the cover must be opened.

There have also been milk containers and the like formed of paper or plastic in which the opening is hermetically sealed with a piece of paper to form an original manufacturer's seal. However, the seals of these containers are hard to remove, and upon removal leave a residue in the form of paste or the like on the opening from which the seal was removed.

SUMMARY OF THE INVENTION

Accordingly, an object of the present invention is to provide a bag-shaped container which eliminates the complicated structure of the conventional containers which require a user to first cut the corner of the container to form an opening and then insert a straw.

It is a further object of the present invention to provide a container which can readily provide an indication of whether or not the original seal has been opened or tampered with.

It is still a further object of the present invention to provide a container in which the seal of the container can be opened simultaneously upon opening of the container.

It is still a further object of the present invention to provide a seal which does not leave a residue on the opening of the container.

According to the present invention, there is provided a bag-shaped container formed by heat-sealing the edges of synthetic resin film sheets or paper sheets laminated with synthetic resin film. A straw is heat-sealed between the sheets and in fixed contact therewith. The straw projects outwardly from the container at the upper end portion thereof and extends to the vicinity of the bottom of the container at the lower end thereof. A threaded cover is engaged on a threaded end portion of the straw for screwing on and off the cover. The cover contains a plurality of teeth around its lower peripheral edge. Each of the teeth contain a guide side and a cut side. A frangible member is provided in the rotary path of the teeth in the vicinity of the upper end portion of the straw. The frangible member is elastically deformed towards the guide side of the teeth when screwing on the cover and is cut away upon contact with the cut side of the teeth when screwing off the cover. Thus, the container of the present invention eliminates the complicated structure of conventional containers which require a user to first cut the corner of the container to form an opening and then insert a straw. The tamper-proof means of the present container allows a user to readily known whether or not the original manufacturer's seal has been removed or tampered with. Additionally, the present container will not leave a residue around the opening of the container after it is opened.

The above and other related objects and features of the invention will be apparent from a reading of the following description of the disclosure found in the accompanying drawing and the novelty thereof pointed out in the appended claims.

BRIEF DESCRIPTION OF THE DRAWING

The single FIGURE is a perspective view of a container with a straw constructed according to the present invention.

DESCRIPTION OF THE PREFERRED EMBODIMENT

The present invention will now be described in more detail with reference to the accompanying drawing.

As shown in the single FIGURE, container 1 is a bag-shaped container formed by heat-sealing the edges of synthetic resin film sheets or by heat-sealing the edges of paper sheets laminated with synthetic resin film. A straw 2 projects outwardly at the upper end portion 3 of the container 1, and extends at the lower end thereof to the vicinity of the bottom of the container 1. The straw is heat-sealed at edge 6 between sheets 4 and 5. The straw 2 preferably has a length reaching the vicinity of the bottom of the container 1 at the lower end thereof, thereby allowing for a content filled within the container to be completely sucked out. Since the straw 2 is inserted and heat-sealed to the container 1 by means of heat-sealing the straw to the container between the edges, the content in the container 1 does not leak from the mounted part of the straw 2. When the content in the container 1 is sucked through the straw 2, the container 1 itself is contracted, thereby readily allowing for the content within container 1 to be sucked out via the straw 2.

A cover 7 is threaded on the upper end portion 3 of the straw 2 thereby providing a hermetically sealed structure. First, second and third flanges 8, 9 and 10 are respectively formed at the upper end portion 3 of the straw 2 at predetermined intervals. The lowermost third flange 10 is contacted with the upper end of the heat-sealed edge 6 of the container 1. The second flange 9 of the straw 2 is used as a holder during the manufacturing step of conveying the container 1 when filling a content in the container 1. The first flange 8 of the straw 2 is used as a holder during the manufacturing step of moving the container from the conveying step for threading the cover 7 on the container 1.

A supporting piece 20 stands at a substantially right angle on one end of the upper surface of the first flange 8 of the straw 2. A protrusion 11 is projected from the supporting piece 20 towards the upper end portion 3 of the straw 2, and a thin frangible member 12 is extended between the end portion of the protrusion 11 of the supporting piece 20 and the first flange 8 of the straw 2. The frangible member 12 is formed of a plastic material having a predetermined elasticity, and allows member 12 to be collapsed or cut when a predetermined external force is applied thereto.

Male threads are formed on the outer peripheral surface of the upper end portion 3 of the straw 2. The cover 7 is engaged with the upper end portion 3 of the straw 2 by engaging the male threads on the straw 2 with the female threads on the inner peripheral surface of the cover 7. When the cover 7 is turned clockwise, the container 1 is sealed by the cover 7. When the cover 7 is turned counterclockwise, the container 1 is opened.

A plurality of teeth 13 of sawtooth shape extend outwardly from the lower outer peripheral surface of the opening end of the cover 7. The teeth 13 of the cover 7 project from the outer peripheral surface of the cover 7 so that the end parts of the teeth 13 make contact with the thin frangible member 12 when the cover 7 is engaged with the upper end portion 3 of the straw 2. Each tooth 13 is formed in a substantially triangular shape having an obtuse angle. Each tooth 13 contains a guide side 14 gradually bent outwardly from the outer peripheral surface of the cover 7 and a cut side 15 extending outwardly with an obtuse angle to the outer peripheral surface of the cover 7. Thus, a hermetically sealed structure is formed by securing cover 7 onto container 1.

An example of the hermetically sealed structure described above will now be described in detail. When the cover 7 is threaded onto the upper end portion 3 of the straw 2, and turned clockwise, the guide pieces 14 of the teeth 13 on the cover 7 make contact with the thin frangible member 12. Since the frangible member 12 has a predetermined elasticity as indicated above, the member 12 is not cut but urged outwardly of the cover 7 along the guide sides 14. The cover 7 is then turned until the upper end portion 3 of the straw 2 is completely hermetically sealed. Accordingly, the cover 7 can be screwed onto the container 1 without cutting the thin frangible member 12 by the teeth 13 of the cover.

When the screwed-on cover 7 is turned counterclockwise, the cover 7 is removed from the upper end portion 3 of the straw 2. At this time, the cut side 15 of the tooth 13 makes contact with the frangible member 12. When the cover 7 is further turned, the frangible member 12 is deformed. When the deformation of the frangible member 12 reaches its elastic limit, the frangible member 12 is cut by the teeth 13. When the cover 7 is further turned, the cover 7 is disengaged from the upper end portion 3 of the straw 2, and the container 1 is opened. Therefore, the cover 7 is not opened unless the frangible member 12 is cut.

As described above, the container of the present invention allows for the original manufacturer's seal of the container to be broken simultaneously upon opening of the container as operated above. Also, a user can determine whether or not the original manufacturer's seal has been broken or tampered with by observing whether the thin frangible member has been cut.

While there have been shown and described fundamental novel features of the invention as described in a preferred embodiment, it will be understood that various omissions and substitutions and changes in the form and details on the device illustrated and in its operation may be made by those skilled in the art. It is the intention, therefore to be limited only as indicated by the scope of the following claims.

What is claimed is:

1. A beverage container comprising:

at least two synthetic resin film sheets, the edges of which are heat-sealed together to form a bag, said bag having a top edge, a bottom edge, and first and second opposing gusset sides;

a tube-like structure having an external portion projecting outwardly from the top edge of said bag and an internal portion extending into said bag, said tube-like structure being heat-sealed between said at least two sheets at said top edge, said tube-like structure including:

a lower flange oriented in a plane parallel to said top edge and in contact therewith;

an upper flange situated above said lower flange and parallel thereto;

a supporting piece projecting from one end of the upper surface of said upper flange;

a protrusion projecting from said supporting piece towards the external portion of said tube-like structure;

a frangible member extending between the end of said protrusion of said supporting piece and said upper flange; and a cover threadably connected at the external portion of said tube-like structure and having a plurality of circumferential projections, each of said projections having a guide side and a cut side, said projections forming a rotary path which contacts said frangible member;

said frangible member being elastically deformed by the guide side of said projections when mounting said cover to said tube-like structure an being cut by engagement of the cut side of said projections when separating said cover from said tube-like structure to provide a visual indication that said cover was removed from said tube-like structure.

2. The beverage container of claim 1, wherein said sheets are paper laminated with synthetic resin film.

3. The beverage container of claim 1, wherein said tube-like structure is a straw.

4. The beverage container of claim 1, wherein said frangible member is plastic and cut when a pre-determined force is applied to said frangible member by the cutting edge of one of said plurality of projections.

* * * * *